United States Patent [19]

Calloway

[11] Patent Number: 4,714,254

[45] Date of Patent: Dec. 22, 1987

[54] BOARD GAME SIMULATING EDUCATIONAL METHODS INVOLVING SCHOOL OR COLLEGE CURRICULUMS

[76] Inventor: Danny L. Calloway, 3814-6 Chamberlayne Ave., Richmond, Va. 23227

[21] Appl. No.: 807,443

[22] Filed: Dec. 10, 1985

[51] Int. Cl.[4] ..... A63F 3/00
[52] U.S. Cl. ..... 273/249
[58] Field of Search ..... 273/243, 248, 249, 256

[56] References Cited

U.S. PATENT DOCUMENTS

| | | | |
|---|---|---|---|
| 1,635,734 | 7/1927 | Ziegler | 273/249 |
| 4,121,823 | 10/1978 | McBride | 273/243 X |
| 4,273,337 | 6/1981 | Carrera et al. | 273/243 |
| 4,354,684 | 10/1982 | McKinley | 273/256 |

OTHER PUBLICATIONS

PM Software Monitor; "The Best in Chess", Popular Mechanics; May, 1983; p. 62.

*Primary Examiner*—Richard C. Pinkham
*Assistant Examiner*—Matthew L. Schneider

[57] ABSTRACT

A game which can be played competitively by two to eight persons, and which simulates educational methods involving the school or college curriculum, is comprised of a flat board containing one sequence of outer playing spaces and associated pictorial and/or printed indicia and at least one sequence of inner playing spaces and associated pictorial and/or printed indicia. Playing pieces are adapted to be moved by a player a number of outer playing spaces dictated by a number-selecting device. Other playing pieces are adapted to be moved by a player a number of inner playing spaces dictated by the passing of a test. The game also includes two sets of question and answer cards that represent lessons and tests for the players. By correctly answering the test questions, players can advance their playing piece on the inner playing spaces.

18 Claims, 6 Drawing Figures

BOARD GAME SIMULATING EDUCATIONAL METHODS INVOLVING SCHOOL OR COLLEGE CURRICULUMS

BACKGROUND OF THE INVENTION

This invention concerns a board game apparatus and is directed particularly to a game involving educational methods which reinforces what's taught in the classroom and develops vital skills to complement the school or college curriculum in reading, writing, spelling, math, english, science, social studies, and so on.

One object of this invention is to provide a game which simulates school or college activity involving lessons and tests in the classroom environment.

Another object of this invention is to provide a game of the aforesaid nature which can be played competitively by two to eight persons.

A further object of this invention is to provide an easily understood, interesting, educational, and economically manufactured board game of the aforesaid nature involving factors of chance and knowledge in the playing thereof.

These objects and other objects and advantages of the invention will be apparent from the following description.

SUMMARY OF THE INVENTION

The above and other beneficial objects and advantages are accomplished in accordance with the present invention by a board game apparatus comprising:

(a) a playing board of rectangular perimeter having pictorial and/or printed indicia including outer and inner playing spaces thereon, (b) a first set of cards carrying appealing illustrations and/or indicia representing tests, (c) a second set of cards carrying appealing illustrations and/or indicia representing lessons, (d) a clock containing pictorial and/or printed indicia representing 6 numerals which will be spun to indicate the number of spaces that a player moves his playing piece on said outer playing spaces, (e) a first set of playing pieces adapted to be moved on outer playing spaces by a player a number of spaces dictated by the spin of the clock, (f) a second set of playing pieces adapted to be moved on inner playing spaces by a player a number of spaces dictated by the passing of a test.

BRIEF DESCRIPTION OF THE DRAWING

For a fuller understanding of the nature and objects of the invention, reference should be had to the following detailed description taken in connection with the accompanying drawing forming a part of this specification in which numerals of reference indicate corresponding parts in all figures of the drawing.

DESCRIPTION OF THE PREFERRED EMBODIMENT

Figure 1:
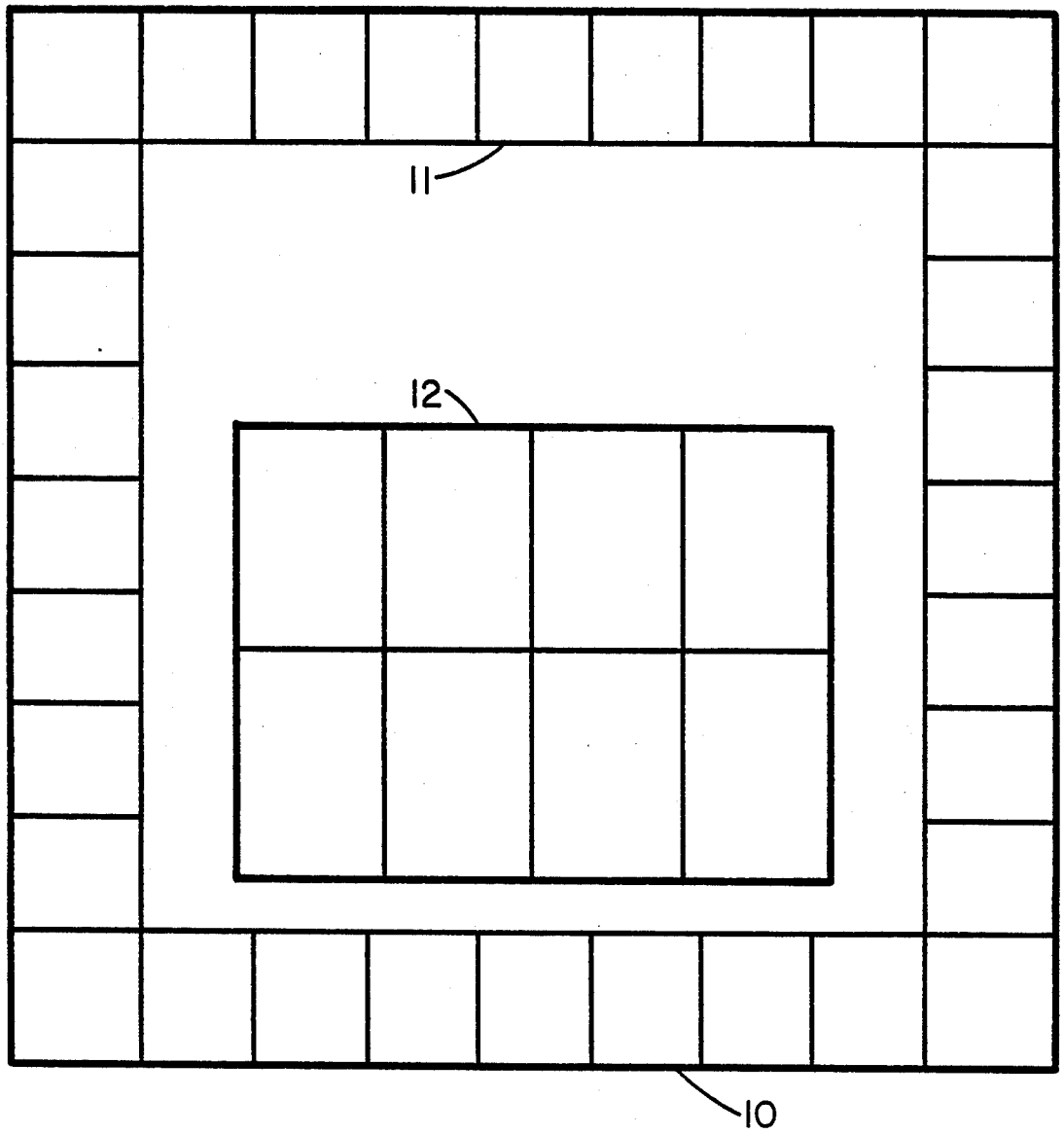
FIG. 1 is a top plan view of an embodiment of playing board of this invention.

Referring to FIG. 1, a playing board 10 of or like thick cardboard containing outer playing spaces 11 and inner playing spaces 12 is shown.

The playing board 10 contains printed indicia comprising a series of 32 outer playing spaces 11 arranged in rectangular configuration, and comprised of four identical corner spaces of rectangular shape, and side spaces of identical appearance aligned between said corner spaces.

Within the rectangular array of outer playing spaces 11 is printed indicia comprising a series of 8 inner playing spaces 12 arranged in rectangular configuration and comprised of two sets of 4 identical spaces aligned adjacent to one another.

Further indicia of numerical, worded, or pictorial nature may be confined within the aforementioned outer and inner spaces, said indicia constituting instructions for the playing of the game.

All of the inner playing spaces 12 represent teachers' classrooms within a school or college, and designates which player is in a particular class. Any number of players may be in the same classroom at the same time. One means for said designation of players in a class comprises playing pieces being located on a particular inner space. Two to eight of said playing pieces would be utilized, one for each player. Only one class can be conducted in any of the 8 classrooms. Since, there are 8 classrooms there will be 8 classes. Each player is required to pass tests for all 8 classes.

Figure 6:
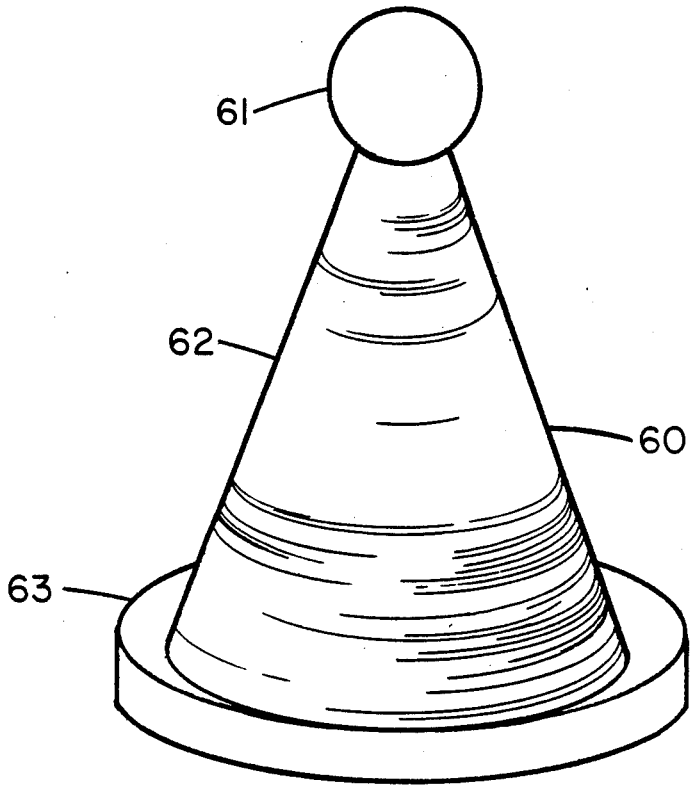
FIG. 6 is a perspective view of an embodiment of a playing piece of said first and second sets.

The playing piece 60 shown in FIG. 6 is comprised of a spherical member 61, a conical member 62, and base 63 which enables the playing piece to be self-standing. The playing piece represents the player. It is adapted to fit within the outer and inner playing spaces. One of said playing pieces will travel on the outer playing spaces 11. Another one of said playing pieces will travel on the inner playing spaces 12. The game of this invention utilizes eight sets of said playing pieces, each differentiated by color, shape, or printed indicia.

Figure 2:
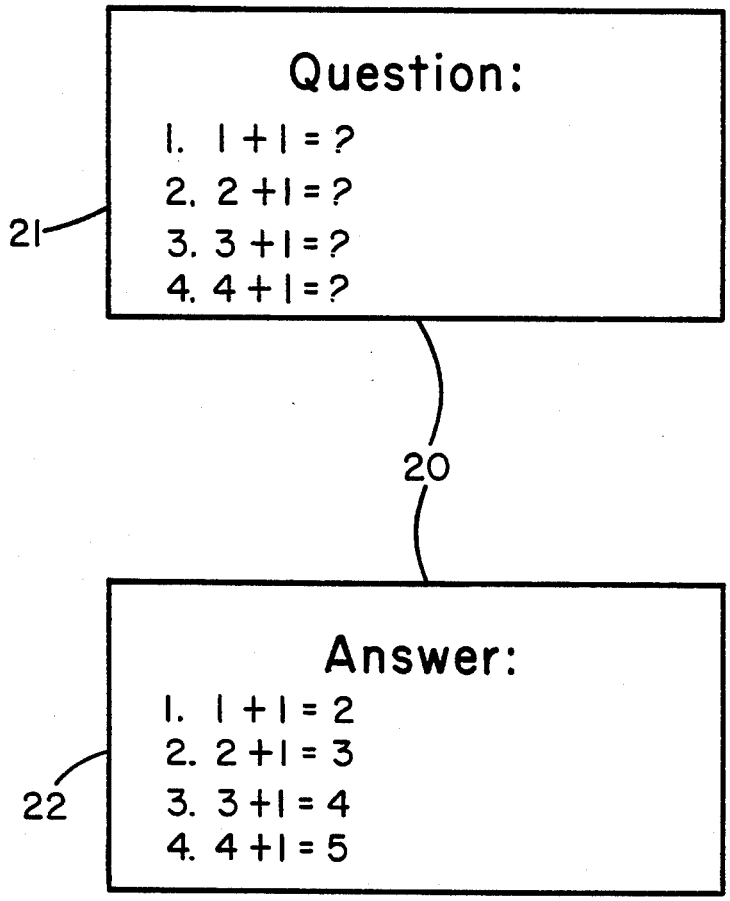
FIG. 2 is a plan view of an embodiment of a lesson card.
Figure 3:
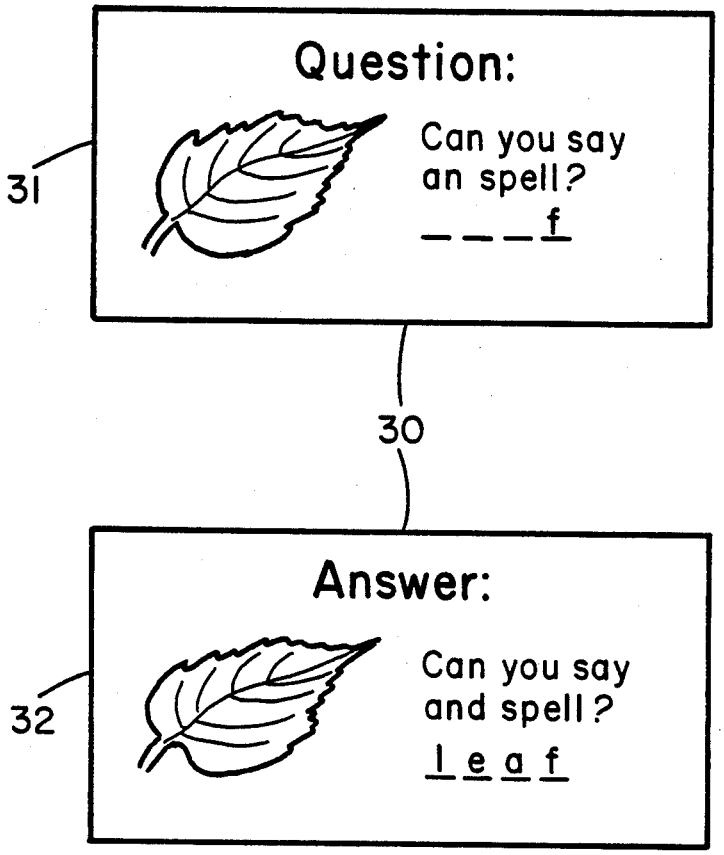
FIG. 3 is a plan view of an embodiment of a test card.

Embodiments of cards 30 and 20 of said second and first sets respectively are shown in FIGS. 2 and 3 respectively. Each card is about 3" by 2", carrying pictorial and/or printed indicia on one or both faces representing questions, answers, and/or appealing illustrations. The front 21 and 31 of said cards 20 and 30 respectively may contain questions. The back 22 and 32 of said cards 20 and 30 respectively may contain answers. The indicia carried by the second set of cards represent lessons. The indicia carried by the first set of cards represent tests.

Figure 4:
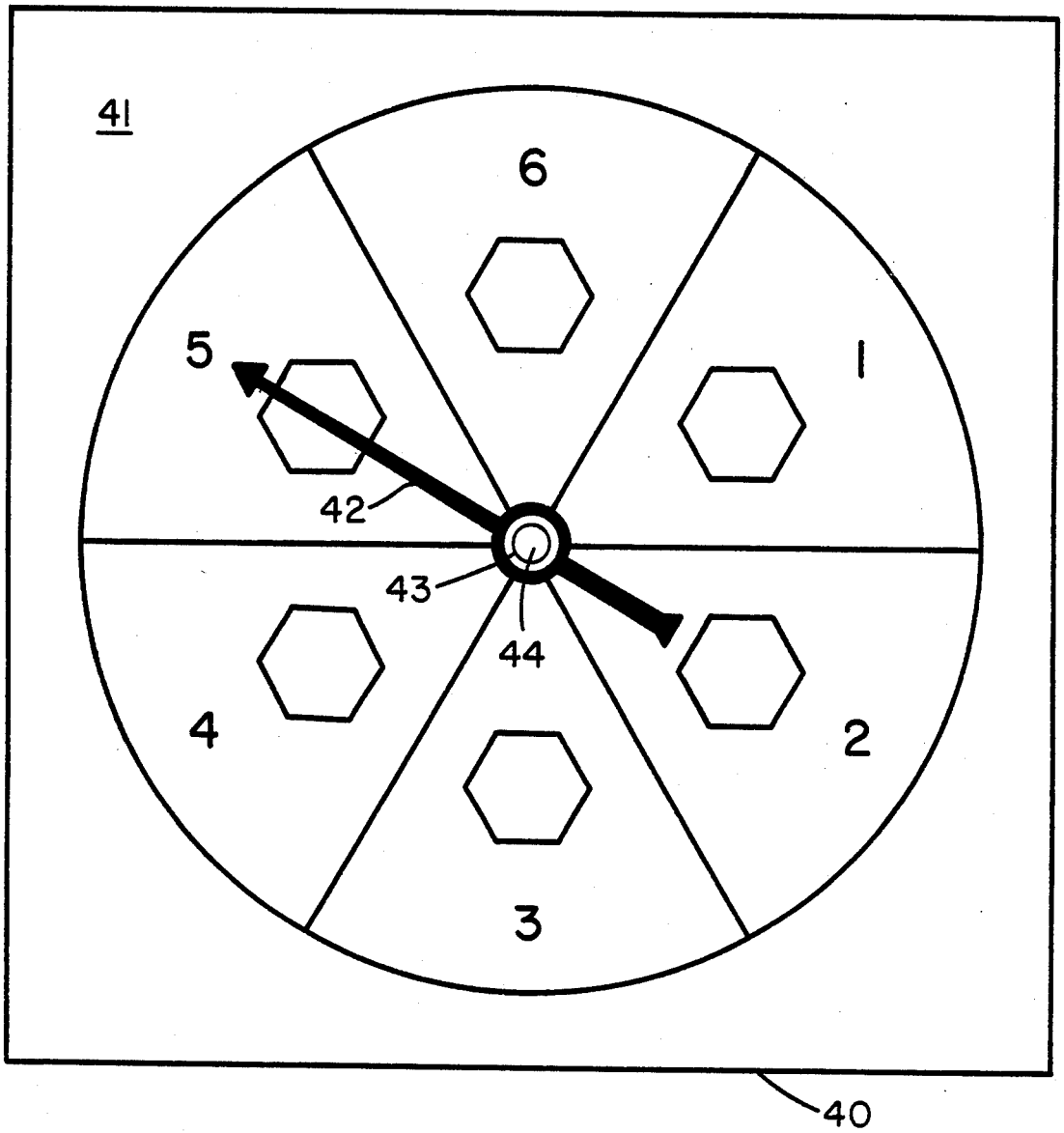
FIG. 4 is a top plan view of an embodiment of a spinning clock.
Figure 5:
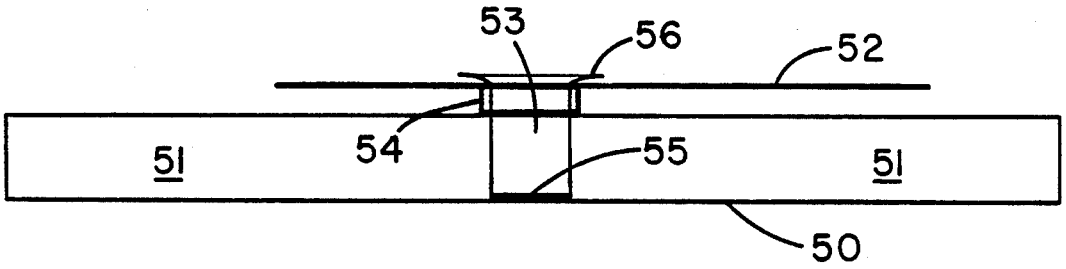
FIG. 5 is a perspective view of an embodiment of a spinning clock.

Referring to FIGS. 4 and 5, a spinning clock 40 and 50 respectively for the game of this invention is shown comprised of a flat square member 41 of or like thick cardboard, a flat arrow-shaped member 42, and a cylindrical member 53 which is outwardly flared 56 from the open upper extremity so that it will secure said arrow-shaped member to said flat square member. The arrow-shaped member 42 is hollow and cylinder shaped 54 in its center so that it could be spun in any direction on the cylindrical member 53. The open lower extremity 55 of said cylindrical member will be attached to said flat square member. The flat square member 41 is about 2" to 4" square, carrying indicia representing the outline of a pie which is divided into 6 equal slices. Each of the said 6 slices will contain pictorial and/or printed indicia representing one of the numerals 1 through 6. Each of said slices would contain a different numeral. The clock contains a hand that could be spun in any direction indicating any of the 6 numbers. The clock is used to indicate the number of spaces that a player moves his playing piece 60 on the outer playing spaces 11.

In playing the game, each player puts one of his playing pieces on the starting space and the other on the first classroom space. Said starting space will be one of the outer playing spaces 11 in FIG. 1. Said classroom space will be one of the inner playing spaces 12 in FIG. 1. Each player must move his playing piece from the starting space in a counterclockwise direction. The number of outer playing spaces that a player moves his playing piece may be determined by a spin of the clock. As a playing piece comes to rest on an outer playing space, the player must follow the instructions on that space. The player may be required to read aloud and answer aloud one or more questions from the lessons or tests card deck. If the player does not know the answer to any of the lesson or test questions, he can get the answer from the back of that card. If the player misses any of the test questions, his other playing piece remains on the current classroom space. If the player answers all of the test questions correctly, he advances his other playing piece from its current classroom space to the next classroom space. A smart player will answer all of his test questions correctly and advance his other playing piece to the next classroom space, thereby coming closer to completing all of the 8 required classes. Other players will repeat classes. The first player to pass all of the 8 required classes is the winner. A player passes a class when he correctly answers all of his test questions without looking at the answers from the selected test card.

At the outset, each player spins the clock. The player receiving the highest number plays first by moving his playing piece on the outer playing space the spinned number of outer playing spaces.

Some of the outer playing spaces are designated areas and/or situations within a school or college. Some of said areas and/or situations may for example be pictorial and/or printed indicia representing one or more persons sitting in in the corner, at the playground, or having lunch. Some of the outer playing spaces contain instructions for the playing of the game. Some of said instructions may require a player to do a lesson or take a test. Other of said instructions may require a player to go sit in the corner, go to the playground, go to lunch, play again, go back any number of spaces, or advance any number of spaces.

One embodiment of the game of this invention utilizes lesson and test cards containing questions, answers, and/or appealing illustrations concerning various subject matter.

Another embodiment of the game of this invention utilizes a third set of cards representing grade report cards and/or diplomas. Said grade report cards and/or diplomas will carry pictorial and/or printed indicia on one of both faces. Said pictorial indicia will be an outline of or a picture of a cap and/or gown. Said printed indicia will be of worded nature denoting the passing of a grade or the graduating of a person from school or college. Said grade report cards may for example be issued when a player completes the 8 required classes, thus passing to the next grade. Said diplomas may for example be issued when a player completes high school, college, or graduate school. A player completes high school or college when he finishes his senior year. A player completes graduate school when he finishes 2 to 4 years of graduate school depending on the subject matter. In this game, a player completes 1 year of school or college when he passes all of the 8 required classes.

Another embodiment of the game of this invention utilizes playing pieces having the appearance of dunce hats, school buses, pencils, graduating caps, books, lunch boxes, brief cases, and people. The dunce hats, school buses, graduating caps, brief cases, and people will be self standing. The pencils, books, and lunch boxes will lay flat on the playing board. Each playing piece represents or identifies each player. Each playing piece is adapted to fit within the outer and inner playing spaces. One set of said playing pieces will travel on outer playing spaces 11. Another set of said playing pieces will travel on inner playing spaces 12. The game of this invention utilizes eight sets of said playing pieces, each differentiated by color, shape, or printed indicia.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A board game apparatus comprising:

a playing board having an outer playing path and an inner playing path, said outer and inner playing paths being separate and unconnected, said outer playing path comprising an endless arrangement of connected playing spaces, said inner playing path comprising a plurality of spaces representing classrooms;

a plurality of playing pieces for use by the players, said playing pieces comprising two playing pieces for each player, a first of said playing pieces being adapted to be placed on the outer playing path to indicate a player's position on that playing path and a second of said two playing pieces being adapted to be placed on the inner playing path to indicate a player's position on that playing path; a number selecting means for indicating the number of playing spaces in the outer path that a player is to move his playing piece;

a first set of cards having indicia thereon representing problems or questions to be solved by the players, said first set of cards representing tests;

at least some of said spaces on said outer playing path having indicia relating to said first set of cards such that when a player's playing piece lands on one of said spaces having said indicia therein, the player is directed to pick up one of said first cards representing tests;

said first set of cards being related to said inner playing path such that upon correctly solving the problem(s) or answering the question(s) contained thereon, a player can move his second playing piece to the next playing space on said inner path.

2. The board game of claim 1 having a second set of cards carrying pictorial and/or printed indicia thereon representing lessons.

3. The board game of claim 2 wherein at least one of said lesson or test cards has questions thereon relating to school or college curriculum.

4. The board game of claim 2 wherein at least some of said spaces on said outer playing path have instructional means thereon for indicating that a player is to answer one or more questions on said first card.

5. The board game of claim 2 wherein at least some of said spaces on said inner playing path represent teacher's classrooms within a school or college so as to designate which player is in a particular class.

6. The board game of claim 1 wherein said outer playing path comprises a series of playing spaces arranged in rectangular configuration and comprised of four identical corner spaces of rectangular shape, and side spaces aligned between corner spaces.

7. The board game of claim 1 wherein said inner playing path comprises a series of playing spaces arranged in rectangular configuration and comprised of two or more sets of spaces aligned adjacent to one another.

8. The board game of claim 1 wherein at least one of playing spaces of said outer playing path contains indicia constituting instructions that the player obtains further playing instructions from another one of said playing spaces.

9. The board game of claim 2 wherein said lesson and test cards have questions, answers and/or appealing illustrations located thereon.

10. The board game of claim 1 wherein said number-selecting means is a spinning clock.

11. The board game of claim 1 wherein the indicia contained on sone of playing spaces of said outer playing path constitute instructions that pertain to disciplinary matters or the participation of players in school or college incidents and/or activities.

12. The board game of claim 1 further comprising a grade report card that is to be issued when a player completes the required number of courses, thus completing one year of school or college and/or a diploma that is to be issued when a player graduates from school or college.

13. The board game of claim 1 wherein said plurality of playing pieces comprise two sets of eight different playing pieces adapted to fit within the playing spaces of said outer playing path and inner playing path and having the appearance of dunce hats, school buses, pawns, pencils, books, graduating caps, lunch boxes, brief cases and/or people.

14. The board game of claim 1 wherein each of said lesson and test cards is comprised of a plurality of questions and answers with each question and answer belonging to a particular category.

15. The board game of claim 12 wherein at least some of said spaces on said outer playing path have instructional means thereon for indicating that a player is to answer one or more questions on said first card.

16. The board game of claim 15 wherein at least one of said test cards is comprised of cards containing questions and answers relating to a plurality of school or college subjects.

17. The board game of claim 12 wherein at least some of said spaces on said inner playing path represent teacher's classrooms within a school or college so as to designate which player is in a particular class.

18. The board game of claim 17 wherein at least one of said test cards has questions and answers thereon relating to a plurality of school or college subjects.

* * * * *

UNITED STATES PATENT AND TRADEMARK OFFICE

CERTIFICATE OF CORRECTION

PATENT NO. : 4,714,254

DATED : December 22, 1987

INVENTOR(S) : Danny L. Calloway

It is certified that error appears in the above-identified patent and that said Letters Patent is hereby corrected as shown below:

Claim 15, line 1, "claim 12" should be --claim 1--.

Claim 17, line 1, "claim 12" should be --claim 1--.

Claim 11, line 2, "sone" should be --some--.

Signed and Sealed this

Fifteenth Day of November, 1988

*Attest:*

*Attesting Officer*

DONALD J. QUIGG

*Commissioner of Patents and Trademarks*

UNITED STATES PATENT AND TRADEMARK OFFICE

CERTIFICATE OF CORRECTION

PATENT NO. : 4,714,254

DATED : 12-22-87

INVENTOR(S) : Danny L. Calloway

It is certified that error appears in the above-identified patent and that said Letters Patent is hereby corrected as shown below:

Column 1:
line 65: "perspective" should be changed to --sectional--.

Column 2:
line 44 "FIGS. 2 and 3" should be changed to --FIGS. 3 and 2--.

Claim 5:
lines 2 and 3: "teacher's" should be changed to --teachers'--.

Claim 14:
line 2: "lesson and" should be deleted.

Claim 15:

line 4: "said first card." should be changed to --any one(s) of said first cards.--.

Claim 17:

line 3: "teacher's" should be changed to --teachers'--.

UNITED STATES PATENT AND TRADEMARK OFFICE

CERTIFICATE OF CORRECTION

PATENT NO. : 4,714,254

DATED : 12-22-87

INVENTOR(S) : Danny L. Calloway

It is certified that error appears in the above-identified patent and that said Letters Patent is hereby corrected as shown below:

Claim 3:
line 3: "school or college curriculum" should be changed to --school curriculum or college curriculum--.

Claim 11:

line 4 and 5: "school or college incidents and/or activities" should be changed to --school incidents and/or activities or college incidents and/or activities--.

Claim 14:
line 1: add --one-- after the word 'each'.

Claim 16:
line 1: "one" should be changed to --some--.

Claim 16:
lines 3 and 4: "school or college subjects" should be changed to --school subjects or college subjects--.

Signed and Sealed this

Twenty-first Day of February, 1989

*Attest:*

*Attesting Officer*

DONALD J. QUIGG

*Commissioner of Patents and Trademarks*